US005615886A

United States Patent [19]

Chalfin et al.

[11] Patent Number: 5,615,886

[45] Date of Patent: Apr. 1, 1997

[54] WORD FORMING BOARD GAME WITH COLORED TRANSPARENT TILES

[76] Inventors: William Chalfin; Julia M. Chalfin, both of 1435 E. 101 St., Brooklyn, N.Y. 11236

[21] Appl. No.: 520,687

[22] Filed: Aug. 29, 1995

Related U.S. Application Data

[63] Continuation-in-part of Ser. No. 385,421, Feb. 9, 1995.

[51] Int. Cl.[6] ..... A63F 3/00

[52] U.S. Cl. ..... 273/272; 273/299; 273/DIG. 14; 434/170

[58] Field of Search ..... 273/272, 292, 273/293, 296, 299, 304, 306, DIG. 14, 148 R; 446/901; 434/102, 170, 207, 177

[56] References Cited

U.S. PATENT DOCUMENTS

| | | | |
|---|---|---|---|
| 1,332,249 | 3/1920 | Feero | 273/249 |
| 2,072,605 | 3/1937 | Palmer | 273/299 |
| 2,585,924 | 2/1952 | Freedman et al. | 446/401 |
| 3,532,342 | 10/1970 | Simpson et al. | 273/DIG. 14 |
| 3,655,195 | 4/1972 | Bean | 273/272 |
| 4,306,724 | 12/1981 | Brzeznski et al. | 273/272 |
| 4,949,978 | 8/1990 | Berner | 273/DIG. 14 |
| 5,031,918 | 7/1991 | Brill | 273/DIG. 14 |
| 5,280,916 | 1/1994 | Gleason, Jr. | 273/304 |
| 5,282,631 | 2/1994 | Baker | 273/272 |

FOREIGN PATENT DOCUMENTS

| | | | |
|---|---|---|---|
| 885340 | 12/1961 | United Kingdom | 273/272 |

*Primary Examiner*—Willliam M. Pierce
*Attorney, Agent, or Firm*—Robert W. J. Usher

[57] ABSTRACT

A gameboard has a crossword grid with bonus spaces of different values marked in different color indicia indicated on an adjacent key. A chip set includes basic chips having a single letter and corresponding numerical value marked thereon and enhanced chips each having a plurality of regions with respective different letters and corresponding numerical values in respective regions marked thereon for alternative selection to complete words on the grid. The bodies of the chips are transparent so that underlying indicia can be seen therethrough. In an alternative, the chip bodies are colored so that the scoring color seen through the chip will be changed to a third color when a chip of a first color overlies a space of a second color. The colors of different regions of an enhanced chip can also be different providing different scoring values according to the letter selected.

4 Claims, 3 Drawing Sheets

LETTER INVENTORY:

| | | | | | |
|---|---|---|---|---|---|
| A-9 | F-2 | K-2 | P-3 | U-4 | Z-2 |
| B-2 | G-3 | L-4 | Q-2 | V-3 | |
| C-2 | H-3 | M-2 | R-6 | W-3 | BLANK |
| D-4 | I-9 | N-6 | S-4 | X-2 | -2 |
| E-12 | J-2 | O-8 | T-6 | Y-3 | |

AEIORTU ARE NOT ON ANY DUAL-CHIP

WORD FORMING BOARD GAME WITH COLORED TRANSPARENT TILES

This is a continuation-in-part application of Ser. No. 08/385,421, filed Feb. 9, 1995, still pending and titled: Enhanced Playing Chip For Word Games, the disclosure of which is incorporated herein by reference.

FIELD OF THE INVENTION

The invention relates to board games, particularly word games and to playing chips and game boards therefor.

BACKGROUND OF THE INVENTION

In the above noted application, there is described a word game for two or more players wherein players alternately form words by placing chips on a crossword grid on a gameboard to score points. The chip set includes a plurality of basic playing chips each having a single letter and a single numerical value thereon and a plurality of enhanced playing chips each having a first and a second region with a letter and numerical value in the first region and an alternative letter and numerical value in the second region, either of which can be used to form a word by selectively aligning the letter on the first or the second region with an adjacent chip on the crossword grid. The corresponding number value is then added to the player's score.

In some prior word games, selected crossword grid squares or spaces (bonus spaces) receiving the chips are also marked with indicia such as wording which indicates that the numerical value of a letter or word associated with a chip occupying that space, is increased, for example, doubled or tripled. During play, it is usually required for the player first to place his chips on all the spaces necessary to complete a word and then, in order to calculate the score, to temporarily displace individual chips one by one to reveal the indicia on the underlying spaces—which may also require temporarily displacing opponents' chips which are also used in forming the same word, (either intentionally or inadvertently).

This can be an inconvenient and somewhat time consuming procedure, slowing the progress of the game and possibly also causing some irritation and discord among opponents who do not like "their" chips being displaced and, occasionally, incorrectly repositioned.

SUMMARY OF THE INVENTION

One object of the present invention is to obviate the above mentioned disadvantage by forming the chips of a transparent or clear material so that the underlying indicia can be viewed directly through the body of a chip occupying a board space.

This obviates any need to displace the chips after initial placement thereby both ensuring that the game proceeds more speedily and smoothly and obviating possible irritation and discord associated with the previous chip displacement.

Another object of the invention is to provide a gameboard of the crossword grid type wherein indicia indicating squares or spaces of different values comprise correspondingly different colors, with all the squares or spaces of the same value being of the same color, and a color key provided outside the crossword grid.

As a result, the scoring values can be detected more easily from all viewing angles and the playing area of the board can have a less crowded appearance.

It is a further object of the invention to increase the variety of combinations of play by providing transparent chips of different colors so that a space of a first color, viewed through an occupying chip of a second color, will appear to be a third, scoring color, different from the first and the second colors, with the value of the different, changed color indicated by the color key.

For example, a transparent blue chip may be placed on a yellow square to change the scoring color to green.

It is also possible for a second or subsequent chip to be stacked on a chip of different color to change the scoring color of the underlying square when viewed therethrough.

In an alternative embodiment, the individual different regions of an enhanced transparent chip may also be of different colors thereby further increasing the variety of scoring possibilities.

In other embodiments, the chip may also be formed as a magnifying lens enabling an underlying word indicia or color indicia on a square to be seen more easily.

BRIEF DESCRIPTION OF THE DRAWINGS

In order that the invention may be readily understood specific embodiments thereof will now be described by way of example only and with reference to the accompanying drawings in which.

DESCRIPTION OF PARTICULAR EMBODIMENTS

Figure 1A:
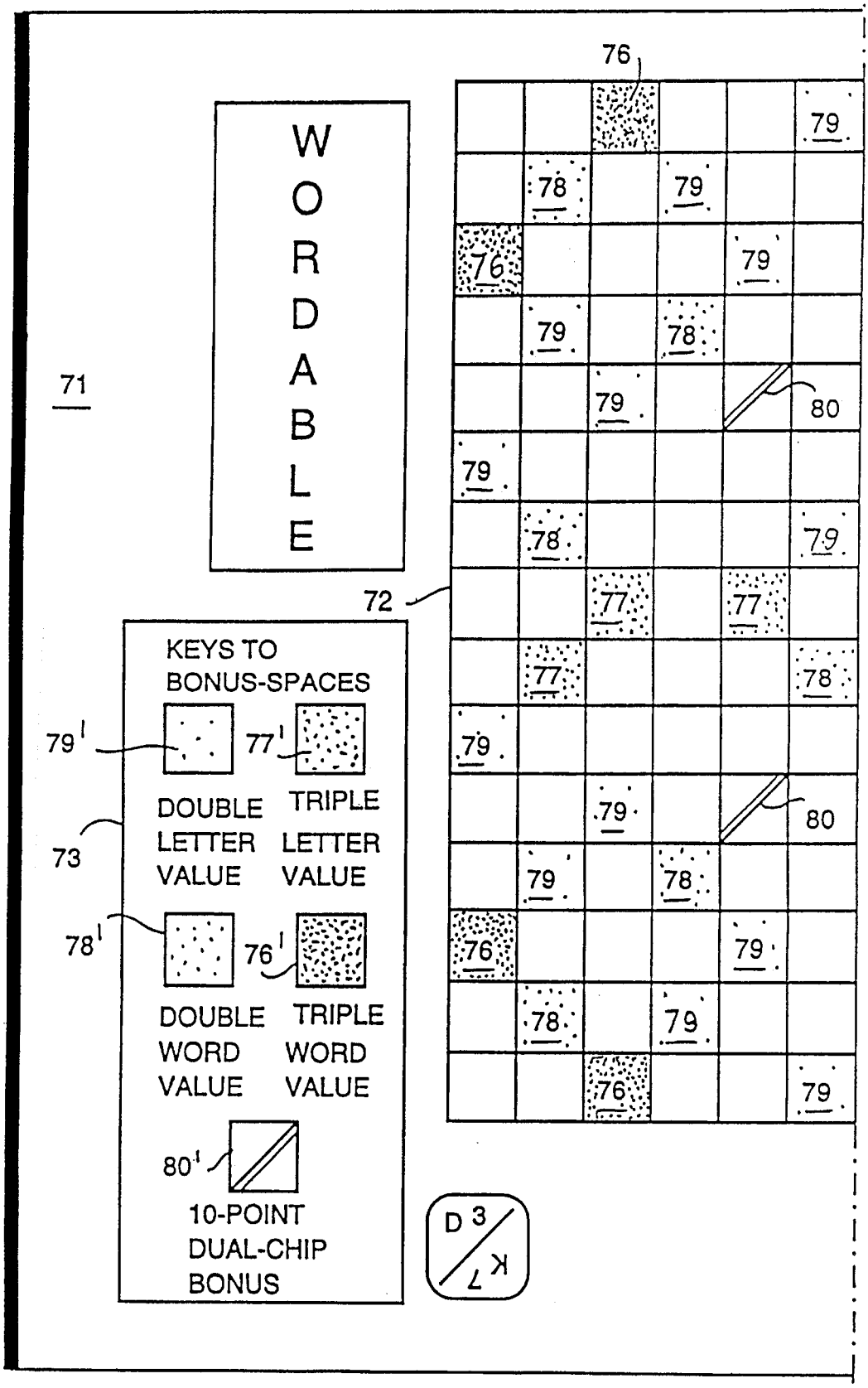
FIGS. 1*a* and 1*b* are combined is a plan view of a game board according to the invention.
Figure 1B:
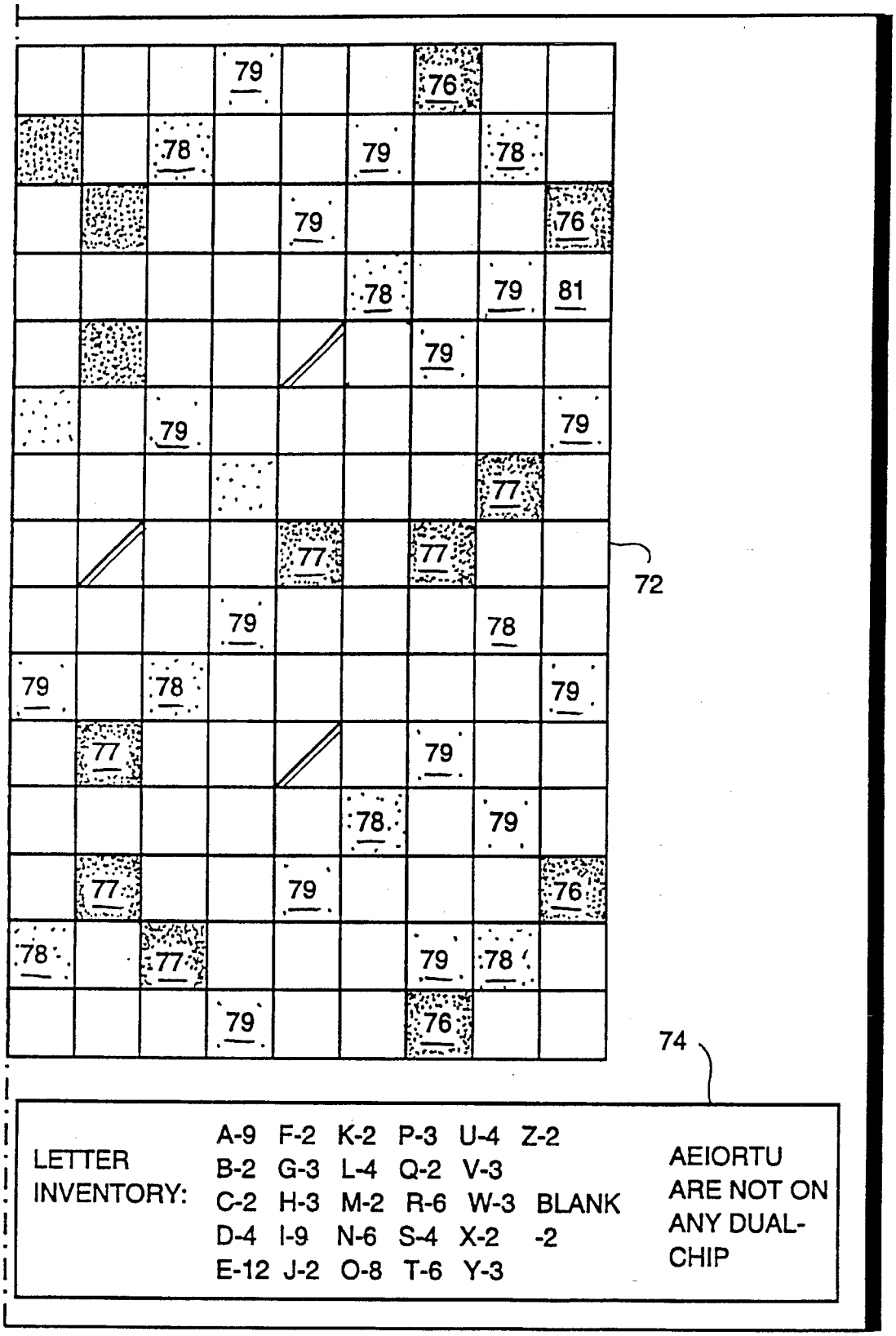

As shown in FIG. 1, the game board 71 comprises two stiff board portions hingedly joined together in known fashion along the parting line of the Figure and providing a playing portion formed as a crossword grid 72 and two adjacent reference or key portions 73 and 74, respectively.

The crossword grid defines 225 chip receiving spaces 76–88, of which there are eight spaces 76 colored red, twelve pink spaces 77, sixteen blue spaces 78, twent-eight yellow spaces 79 and five spaces 80 colored white with a red diagonal stripe outlined in black. The remaining spaces 81 are grey and do not alter the scoring value of a chip placed thereon.

Increased scoring values for letters and words associated with chips occupying respective colored spaces are showed in the key to bonus spaces 72 which includes correspondingly colored boxes 76'–80' with indicia (wording) indicating that yellow and pink spaces 79 and 77, respectively, provide double and triple letter values, respectively, and blue and red spaces 78 and 76, respectively, provide double and triple word values, respectively. The striped space 80 indicates a ten point bonus for an enhanced chip, having the Trademark DUAL-CHIP, placed thereon.

The key portion 74 is a letter inventory assigning numerical values for respective scoring letters (including blanks) on playing chips.

The chip set comprises one hundred individual chips, ten of which are enhanced playing chips 90 and the remaining ninety are basic playing chips. Each chip has a body, square in plan, which is injection molded from transparent or clear acrylic of optical quality on which letter and corresponding numerical values are subsequently printed by a silk screening technique. (Etching lo would be a more expensive alternative.)

Figure 2:
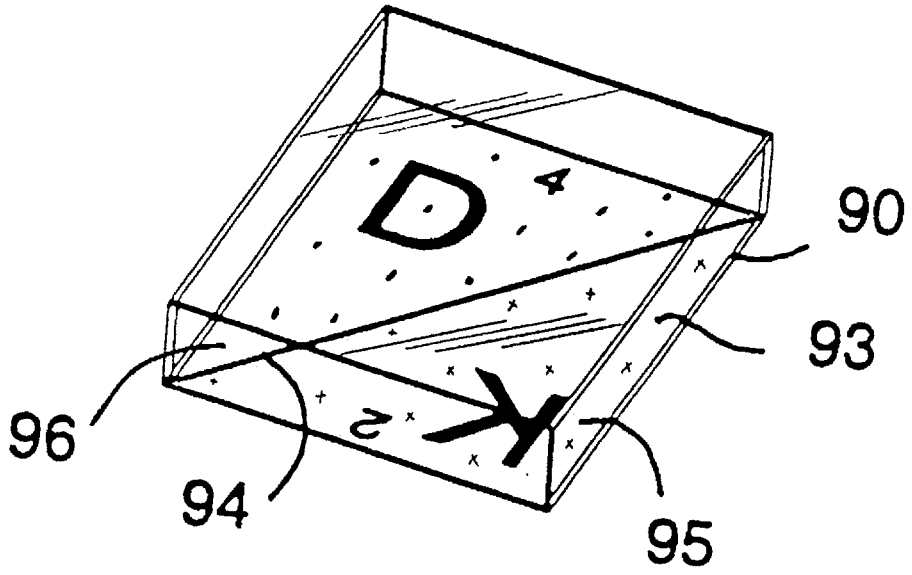
FIG. 2 is a diagrammatic perspective view of an enhanced chip according to the invention; as seen through the upper face thereof.

The basic playing chips each have a single letter and corresponding numerical value marked on a bottom major face thereof while, as shown in FIG. 2, in an enhanced playing chip 90, the bottom major face 93 is divided by a diagonal line 94 to form two regions 95 and 96 each marked with a letter and a corresponding numerical value with the letter and value of one region being different and inverted from the letter and number value of the other region.

A player possessing an enhanced chip may place it onto a space of the crossword grid with either letter aligned correctly with adjacent, word forming letters to select the correctly aligned letter to form a word. The numerical value corresponding to that letter is the score.

When either a basic or an enhanced chip is placed on a colored bonus space, the scoring value of the associated letter or word is increased according to the value indicated in the key with the scoring color of the space being so easily seen through the chip body as to obviate need for subsequent displacement thereof.

It should be noted that marking the letters and numerical values on the bottom major faces of the transparent bodies of the chips (by etching or silk screening) can improve the legibility thereof compared with marking on the top major faces of the chip bodies as a result of refractive effects at least at the upper faces so that the chip bodies act as optical quality lenses.

In an alternative embodiment, not shown, at least the bottom faces of the bodies of at least some of the chips are of different scoring colors so that a grid space marked with a first scoring color, viewed through an occupying chip of a second color, will appear to be a third, scoring color, different from the first and the second colors, with the value of the third scoring color indicated by the scoring color key. Thus, a transparent blue chip can be placed on a yellow square to change the scoring color to green.

The enhanced chips have first regions which are of different scoring colors from respective second regions so that a grid space marked with a first scoring color, viewed through a region of an occupying chip of a second scoring color, will appear to be a third, scoring color, different from the first and the second scoring colors, with the value of the third scoring color indicated by the scoring color key.

Four conventional chip racks (not shown) with high backs are provided which mask the players chips from their opponents.

The rules of the game follow on the next two pages.

Equipment 100 letter-chips, including 10 new DUAL-CHIPS. Each DUAL-CHIP pairs TWO letters. Next to every letter is a number equal to its VALUE.

1 WORDABLE game board with these special spaces:
yellow=multiply LETTER-value by 2
pink=multiply LETTER-value by 3
blue=multiply WORD-value by 2
red=multiply WORD-value by 3
/=DUAL-CHIP space, worth a 10-point bonus whenever you play a DUAL-CHIP on it.

4 chip-racks.

We Recommend:

A dictionary the players choose for resolving challenges.

A bag to contain all the letter-chips not yet drawn.

Object

To score the highest number of points.

To Start

Each player draws a chip. Whoever has the LOWEST letter-value will go first. (If you draw a DUAL-CHIP, add the letter-values!)

Each player may keep or return the chip drawn. Then, starting with the first player, each draws a total of seven chips to set on a chip-rack.

The first player plays a word which will cover the DUAL-CHIP space in the center of the board. The letter-values on each chip are added, and the total is recorded. Play then continues in clockwise order.

Subsequent Plays

Each new play must either:

a) link up with a word already on the board, or b) place an unlinked word that includes a DUAL-CHIP covering a free DUAL-CHIP space.

(Note: If linking a word, any chip may cover a DUAL-CHIP space).

As long as enough chips are in the bag, always draw the chips needed to restore your rack to seven. At no time may your rack contain more than seven chips.

Playing a DUAL-CHIP

Each DUAL-CHIP lets you choose which of two letters to play. Simply place the DUAL-CHIP letter correctly upwards, and then disregard its other half.

Scoring

The total score for your play depends upon the bonus spaces you have covered, and on how many new words you've made. (See example).

Add up the letter-values in each new word formed by your play. Apply the letter-bonuses only to the chips you have played. (Remember: A blank stands for any letter but has no scoring value).

If any chip you placed covers a WORD-bonus space, multiply the word's entire value. The total for all new words is your score for that turn, plus a 10-point bonus if you played a DUAL-CHIP on a DUAL-CHIP space.

8-letter word bonus. If you play all 7 chips and form an 8-letter word (or longer), add a 50-point bonus to your score.

Replacing Chips

At your turn, instead of playing you may exchange up to 6 chips and pass your turn.

Acceptable Plays

ALL vertical or horizontal letter-sequences formed when placing a new word must also be acceptable words.

Abbreviations, slang, foreign, and capitalized words are not allowed.

Diagonal and one-letter words do not count.

Challenging. All words played should be acceptable in the dictionary chosen. Any player may challenge another's play. If that challenge is upheld, the play is withdrawn and the player's turn is lost. But should the challenge be denied, then the challenger's next turn is lost!

Ending the Game

When no more chips remain in the bag, play ends as soon as one player's last letter-chip gets played. As a bonus, that player also receives the sum of the unplayed chips left on the other players' racks. Note: An unplayed DUAL-CHIP counts as the SUM of its two letter-values!

We claim:

1. A word game apparatus for playing a word game on a gameboard having a crossword grid for two or more players where players alternately form words on the crossword grid to score points, the word game set comprising:

a set of playing chips, each playing chip having a letter and numerical value thereon, said chips being for placement on said crossword grid to form words and a gameboard marked with a crossword grid providing chip-receiving spaces at least some of which are marked with scoring colors, different scoring colors indicating different numerical scoring values for ones of letters and words associated with chips placed thereon, a scoring color key on the gameboard outside the crossword grid, chips having transparent bodies so that respective indicia can be viewed directly through the respective bodies of overlying chips and the bodies of at least some of the chips are of different scoring colors so that a grid space marked with a first scoring color, viewed through an occupying chip of a second scoring color, will appear to be a third, scoring color, different from the first and the second scoring colors, with the value of the third scoring color indicated by the scoring color key.

2. A word game apparatus according to claim 1 in which the bodies of at least some of the chips comprise magnifying lenses through which an enlarged image of an underlying indicia can be seen.

3. A word game apparatus according to claim 1 in which the set of chips includes enhanced playing chips the bodies of which each having a first region and at least a second region, said first region containing said letter and said numerical value, said at least a second region containing an alternative letter and an alternative numerical value, wherein said at least one enhanced playing chip is placed on said crossword grid and selectively oriented to form a word with one of:

said letter from said first region with a corresponding numerical value being added to a player's score; and said alternate letter from said at least a second region with a corresponding alternate numerical value being added to a player's score.

4. A word game set apparatus according to claim 3 in which the colors of first regions of at least some of said enhanced chips are different from the colors of respective second regions so that a grid space will appear to have different scoring colors when viewed through first and second regions, respectively.

* * * * *